United States Patent [19]

Fukuda et al.

[11] 4,047,139

[45] Sept. 6, 1977

[54] TRANSFORMERS OF LARGE CAPACITY FOR ULTRA-HIGH VOLTAGES

[75] Inventors: Teruo Fukuda; Tetuo Otomo, both of Hitachi, Japan

[73] Assignee: Hitachi, Ltd., Japan

[21] Appl. No.: 742,264

[22] Filed: Nov. 16, 1976

[30] Foreign Application Priority Data

Dec. 1, 1975 Japan ..... 50-142251

[51] Int. Cl.[2] ..... H01F 21/12

[52] U.S. Cl. ..... 336/150; 323/43.5 R

[58] Field of Search ..... 323/43.5 R; 336/150, 336/180, 185, 145, 146, 147, 148, 137

[56] References Cited

FOREIGN PATENT DOCUMENTS 1,303,841 8/1962 France ..... 336/150

*Primary Examiner*—Thomas J. Kozma

*Attorney, Agent, or Firm*—Craig & Antonelli

[57] ABSTRACT

Disclosed is a transformer of a large capacity for an ultra-high voltage which comprises a core leg coaxially wound sequentially with at least a low voltage winding, a high voltage winding composed of an upper and a lower winding section operated in a parallel connection and having a lead conductor led out from a center portion of the high voltage winding and extending to a terminal to be connected to a high voltage transmission line as well as connection leading-out wires taken out from the top and bottom end portions of the high voltage winding, and an upper and a lower tap winding disposed vertically spaced from each other with a predetermined distance and respectively connected to the upper and lower winding sections of the high voltage winding so as to be operated in a paralled connection therewith. Each of the upper and lower tap windings are disposed such that the magnetic center of each of the tap windings may be located at a height which corresponds to a value in the range of 55 to 65% of the height between the center portion of the high voltage winding at which the lead wire is led out and either ends thereof, whereby axial mechanical forces produced electro-magnetically in the tap windings are significantly reduced and the manufacture of the transformer is facilitated with an improved reliability thereof.

6 Claims, 11 Drawing Figures

TRANSFORMERS OF LARGE CAPACITY FOR ULTRA-HIGH VOLTAGES

FIELD OF THE INVENTION

The present invention relates to an improvement in an autotransformer or a multi-winding transformer having a large capacity in the order of 500 MVA to 1000 MVA or move for handling ultra-high line voltages of 400 to 500 KV.

DESCRIPTION OF THE PRIOR ART

With the increasing demand for electric power, an ultra-high voltage power transmission system with a line-to-line voltage of 500 KV or more has been put into practice.

Figure 1:
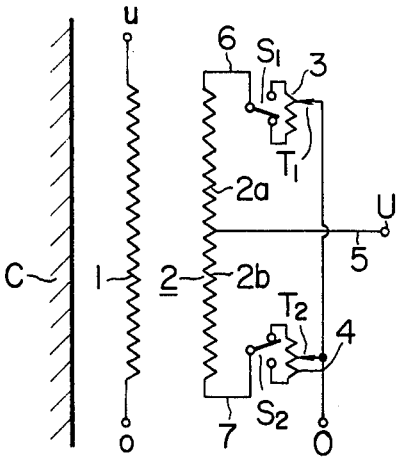
FIG. 1 PRIOR ART
FIGS. 1 and 2 show wiring diagrams of transformers of a large capacity for an ultra-high transmission voltage to which the invention is applied.
Figure 2:
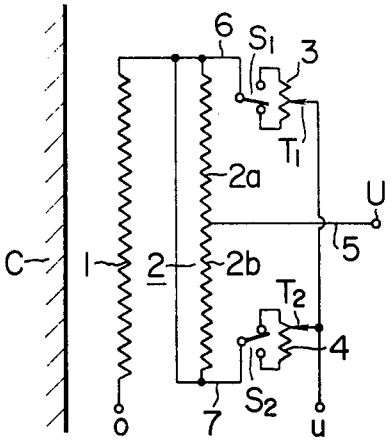
FIG. 2 PRIOR ART

A power transformer to be used in such an ultrahigh voltage transmission system has been heretofore constructed in such a manner as shown in FIGS. 1 and 2. Referring to the figures which shown by way of example only a single phase of a transformer, a core leg C of the transformer is provided with a low voltage winding 1, a high voltage winding 2 and an upper and a lower tap winging in this order as viewed from the innerside or core side of the transformer. The high voltage winding 2 is composed of an upper and a lower winding unit or section 2*a* and 2*b* operative in parallel respectively through the upper and the lower tap windings 3 and 4 which are positioned as spaced from each other with a predetermined distance in the vertical direction. Tertiary winding may be disposed, if necessary, at the innermost side which serves as a stabilizing winding as a countermeasure against high harmonics or as a power source for a substation.

When a transformer of a two-winding construction is realized with the winding arrangement described above, low voltage terminals *u* and *o* are led out from the top and the bottom ends of the low voltage winding 1, while a lead wire 5 is led out from the center portion of the high voltage winding 2, i.e. the junction point between the opposing ends of the upper and the lower winding units 2*a* and 2*b.* The lead wire 5 is connected to a terminal U to be connected to a high voltage transmission line. Extending from the top and the bottom ends of the high voltage winding 2 are lead wires 6 and 7 which are respectively connected to the upper and lower tap windings 3 and 4 through associated polarity changeover switches $S_1$ and $S_2$ and thence to another high voltage terminal 0 through tap changers $T_1$ and $T_2$ so that the upper and the lower high voltage winding units 2*a* and 2*b* may be operated in parallel connections respectively through the upper and lower tap windings 3 and 4.

When an autotransformer is to be realized, the low voltage winding 1 serves as a common winding and the high voltage winding 2 serves as a series winding, as is shown in FIG. 2. One end of the low voltage winding 1 is connected to a low voltage terminal *o,* while the other end thereof is connected to the top and bottom ends of the high voltage winding 2 which is composed of the winding units 2*a* and 2*b* with a lead conductor being led out from the center portion of the winding 2 so that the winding units 2*a* and 2*b* are operated in a parallel ralation respectively through the conductor wires let out from the top and bottom end portions of the high voltage winding 2, the polarity change-over switches $S_1$ and $S_2$, the tap windings 3 and 4 and the tap changers $T_1$ and $T_2$ both of which are in turn led to another low voltge terminal *u.*

Figure 3A:
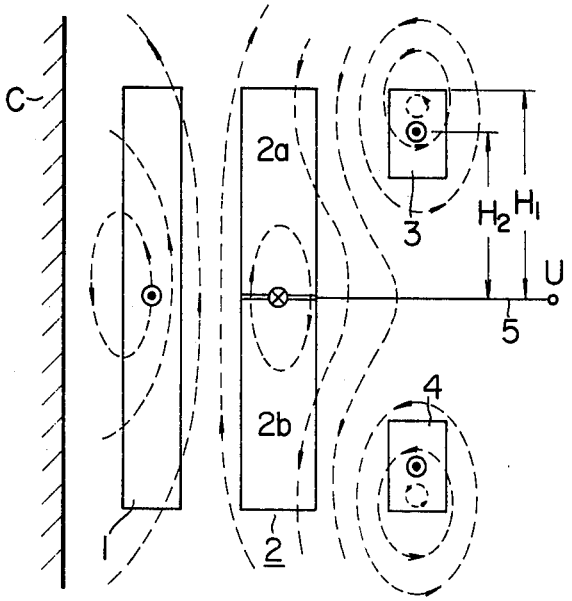
FIG. 3A PRIOR ART
FIG. 3A shows schematically a winding arrangement of a hitherto known large capacity transformer.

In such a transformer of the winding arrangement wherein the core leg C is provided with the low voltage winding 1, the high voltage winding 2, insulating and supporting cylinders (not shown) and so forth in this order from the side of the core leg C, as described above, the top and bottom ends of the outermost upper and lower tap windings, respectively, are usually geometrically so positioned as to be substantially flush with the top and lower ends of the low and high voltage windings 1 and 2, respectively, with a view to attaining a good insulation at the portion of the high voltage winding where the led wire 5 is led out which extends in turn to the terminal U to be connected to the high voltage transmission line, as is indicated in FIG. 3A. Accordingly, each of the magnetic centers of the individual tap windings 3 and 4 along the axes thereof is located at the level $H_2$ which usually corresponds to 70 to 85% of the height $H_1$ as measured from the center of the high voltage winding 2 at which the lead wire 5 is taken out to each end of the winding 2. Of course, the height $H_2$ depends on the type of the tap windings as actually employed. However, in most cases, the magnetic centers of the tap windings are located at the height $H_2$ which approximately corresponds to 75% of the height $H_1$ of each of the high voltage winding units.

Figure 3B:
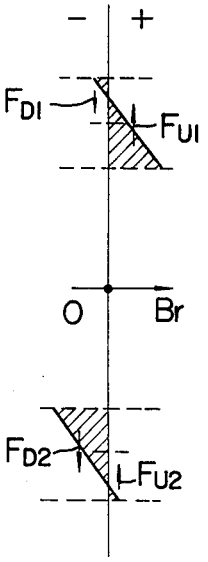
FIG. 3B PRIOR ART
FIG. 3B illustrates the distribution of magnetic flux produced in the tap windings of the winding arrangement shown in FIG. 3A.

With such an arrangement of the upper and lower tap windings 3 and 4 spaced from each other with a predetermined distance, a relatively large quantity of magnetic flux will leak from the space between the tap windings 3 and 4, since the magnetic flux is distributed as represented by broken lines in FIG. 3A, when currents flows through the individual windings 1 to 4 in the directions as indicated by symbols ⊗ and ⊙ which represent directions of current flow toward and from the plane of the drawing, respectively. In the individual tap windings 3 and 4 disposed outermost of the transformer assembly, the distribution of the radial magnetic flux Br is such as illustrated in FIG. 3B. As can be seen from this figure, the absolute quantity of the magnetic flux is greater at the opposite ends of the tap windings 3 and 4 than at the top and bottom ends thereof, so that the positive and negative components of the radial magnetic flux Br in each of the tap windings 3 and 4 are asymmetrical to each other in view of the magnetic center which exists at a substantial axial center of each winding. This results in a great difference between the electro-magnetic mechanical forces $F_{u1}$ and $F_{U2}$ produced axially in the respective tap windings 3 and 4 by the positive radial magnetic flux Br in the upward direction and the electro-magnetic mechanical forces $F_{D1}$ and $F_{D2}$ produced axially in the respective tap windings 3 and 4 by the negative magnetic flux Br in downward direction. Accordingly, when a large current flows through the winding as in the case of the occurrence of a short-circuit, the upper and lower tap windings 3 and 4 are subjected to a large electro-magnetic force in the upward and downward directions, respectively, and tend to expand in the axial or vertical direction in FIG. 3A. Thus, it is required to increase the mechanical strength of the supporting member such as core clamping means (not shown) for securely mounting the windings on the core leg through the interposition of an insulation. Nevertheless, there would arise in an extreme case the distruction of the tap windings 3 and 4 due to the electro-magnetic forces. Accordingly, it is desirable to suppress the generation of such electro-magnetic forces at a minimum as low as possible. It is also noted that in the case of an ultra-high voltage rated autotransformer as shown in FIG. 2, the axial mechanical force produced in each of the tap windings 3 and 4 by the radial magnetic flux is extremely high as compared with the force produced in the two winding type transformer shown in FIG. 1 and will often attain a value greater than 200 tons. Under such circumstances, attempts which have heretofore been made to improve the supporting structure for the windings have proven to be unsatisfactory.

Furthermore, since the low voltage winding 1, high voltage winding 2 and the upper and lower tap windings 3 and 4 disposed coaxially around the core leg C are so positioned as to be substantially in flush with one another at the top and bottom ends thereof, respectively, as described hereinbefore in conjunction with FIG. 3A, the connection lead conductors or wires (not shown) as led out from the ends of the individual windings have to be taken out in a radially dispersed pattern through associated end insulations (not shown), making difficult the connection of the lead-out conductors and providing problems of insulation in the manufacture of the transformer.

SUMMARY OF THE INVENTION

An object of the invention is therefore to provide a transformer of a large capacity for an ultra-high voltage in which axial mechanical forces induced electro-magnetically in an upper tap winding and a lower tap winding connected in parallel and disposed with a vertical distance therebetween around a high voltage winding are significantly reduced.

Another object of the invention is to facilitate the connection of lead-out conductors to the top and bottom ends of the high voltage winding by disposing the upper and the lower tap windings in a suitable manner.

Still another object of the invention is to provide an ultra-high voltage transformer having windings improved in respect of the reliability thereof.

With these objects in view, there is provided according to the invention a transformer of a large capacity for an ultra-high voltage application which comprises a core leg which is coaxially wound sequentially with at least a low voltage winding, a high voltage winding composed of an upper and a lower winding section, and an upper and a lower tap winding, the high voltage winding having a lead conductor led out from a center portion of the high voltage winding at which the opposite ends of the winding sections are connected to each other and having connection lead-out conductors taken out from top and bottom end portions of the high voltage winding, the lead conductor led out from the center portion of the high voltage winding extending to a terminal to be connected to a high voltage transmission line, the upper and lower tap windings being disposed vertically and being spaced from each other with a predetermined distance, the upper and lower sections of the high voltage winding being respectively connected to the upper and lower tap windings so that the upper and lower sections operate in a parallel relation to each other respectively through the upper and lower tap windings, wherein the upper and lower tap windings are disposed such that the magnetic center of each of the upper and lower tap windings is located at a height which corresponds to a value in a range of 55% to 65% of the height between the center portion and each end portion of the high voltage winding. Thus, the oxial mechanical force produced electro-magnetically in each of the tap windings may be reduced significantly. According to another espect of the invention, the top and bottom ends of the upper and lower tap windings, respectively, are located at inwardly retracted positions relative to the top and bottom ends of the high voltage windings, thereby to facilitate the connection of the lead wires or conductors led out from the top and bottom ends of the high voltage winding.

DESCRIPTION OF THE PREFERRED EMBODIMENTS

Figure 4A:
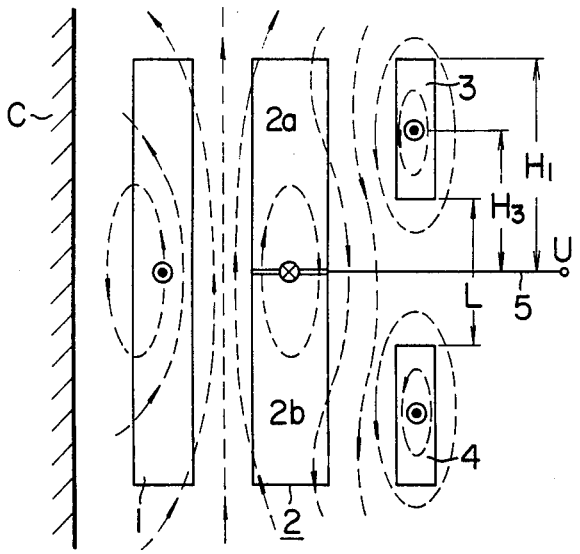
FIGS. 4A and 5A schematically show different winding arrangements for high capacity transformer according to the invention, respectively.
Figure 5A:
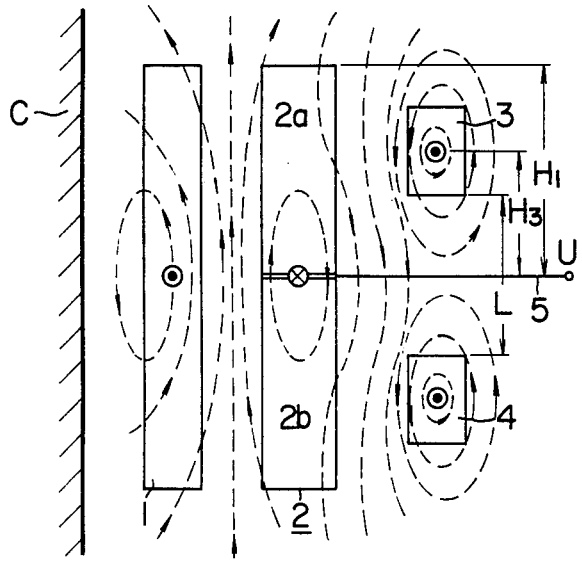
Figure 5B:
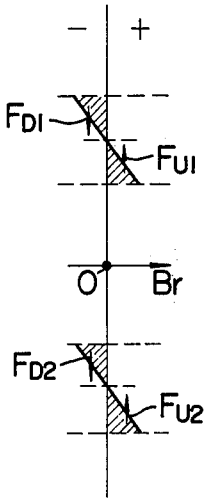

FIGS. 4A and 5B show schematically two different arrangements for one phase of a large capacity transformer for an ultra-high voltage according to the invention. As can be seen from these figures, an iron core C is coaxially wound with a low voltage winding 1, a high voltage winding 2 and an upper and a lower tap winding 3 and 4 in this order as is the case of the hitherto known transformer. A lead-out conductor or wire 5 is led out from the center of the high voltage winding to a terminal U to be connected to a high voltage transmission line so that the high voltage winding 2 is operated in a parallel connection of winding units or sections 2*a* and 2*b*. Special consideration is paid to the disposition of the upper and the lower tap windings which are mounted with a predetermined vertical space therebetween and operated in a parallel connection.

In more particular, assuming that the height corresponding to the axial length of the high voltage winding 2, i.e. the height between the mid portion thereof where the lead wire 5 is led out and either end of the winding 2 is represented by $H_1$, the tap windings 3 and 4 are so disposed that the respective magnetic center of each of the tap windings 3 and 4 is located at a height $H_3$ which corresponds to 55 to 65% of the height $H_1$ as measured from the center leading out portion of the high voltage winding 2 to either end portion of the same.

Figure 4B:
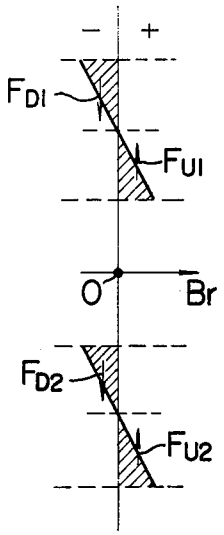
FIG. 4B and 5B illustrate the distribution of magnetic flux in the tap windings of the winding arrangements shown in FIGS. 4A and 5A, respectively.

With such an arrangement of the tap windings 3 and 4, the distribution of magnetic flux as produced upon the current flow through the winding in a direction in parpendicular toward or from the plane of the drawing as represented by symbols ⊗ of ⊙, respectively, will occur such that the leakage of the magnetic flux from the space between the tap windings 3 and 4 is reduced, as illustrated by broken lines, since the space between the tap windings maintained by a cylinderical insulation support (not shown) is decreased as compared with that of the conventional arrangement of the windings described hereinbefore. FIGS. 4B and 5B graphically illustrate the magnetic flux distribution in the upper and lower tap windings 3 and 4 disposed around the high voltage winding 2 with the magnetic center of each of the tap windings located at the above described height $H_3$. As will be seen from FIGS. 4B and 5B, the absolute quantities of the magnetic flux produced at the half upper and the half lower side of each of the tap windings are substantially equal to each other and distributed symmetrically with respect to the magnetic center with opposite polarities. Accordingly, the axial mechanical forces $F_{U1}$ and $F_{D1}$ as well as $F_{U2}$ and $F_{D2}$ produced electro-magnetically in the upward and the downward directions due to the radial magnetic flux of opposite polarities distributed in each of the tap windings 3 and 4 are cancelled by each other, as a result of which substantially no external mechanical forces will be produced and the support of the individual windings can be advantageously implemented in a simplified and easily facilitated manner.

In order that the radial magentic flux of opposite polarities produced in the each of the tap windings is to be almost cancelled out by each other, i.e. the sum of the magnetic flux in each of the tap windings is to be substantially zero, it is desirable to select the height or distance $H_3$ between the center leading-out portion of the high voltage winding and the magnetic center of each of the tap windings at a value which corresponds to about 60% of the height $H_1$, a half of the length or height of the high voltage winding. However, the height or distance $H_3$ may be selected at a suitable value in the above described range in consideration of the insulation between the inner ends of the tap windings and the lead-out portion of the lead conductor 5 connected to the terminal U which is to be connected to the high voltage transmission line so that the axial electromagnetic forces as produced at the failure of short-circuit may be confined in an allowable range.

In the case of the embodiment shown in FIG. 4A, the top and bottom ends of the respective upper and lower tap windings 3 and 4 are disposed in flush with the ends of the other windings 1 and 2. In this case, the lateral or radial widths of the tap windings are decreased, while the axial lengths thereof are increased, so that the magnetic centers of the individual tap windings may be located at the height $H_3$ which lies in the range of 55 to 65% of the height $H_1$ to attain the desired effect of reducing remarkably the axial mechanical forces as generated electro-magnetically.

In the case of the embodiment shown in FIG. 5A, the tap windings 3 and 4 of a conventional type are also so disposed that the magnetic center of each of the windings 3 and 4 may be positioned at the height $H_3$ from the center lead-out portion of the high voltage winding, which height $H_3$ lies in the range of 55 to 65% of the height $H_1$ corresponding to a half of the overall height of the high voltage windings 2. Additionally, it is noted that the top end of the upper tap winding 3 and the bottom end of the lower tap winding 4 are positioned so as to be retracted inwardly relative to the top and bottom ends of the high voltage winding 2. This arrangement shown in FIG. 5A is effective not only in reducing the axial mechanical forces as produced electro-magnetically but also in facilitating the wiring of the lead-out conductors from the top and bottom end portions of the high voltage winding 2 through the space L defined between the respective opposite inner ends of the tap windings 3 and 4.

Experiments were conducted with the transformers of the above described constructions by varying the positions of the magnetic centers of the individual tap windings to measure the electro-magnetically induced mechanical forces for comparison with those produced in the conventional winding structure. It was found that when the magnetic center of each of the tap windings 3 and 4 was located at the value corresponding to about 60% of the height $H_1$ between the center lead-out portion and each of the outer ends of the high voltage winding, the electro-magnetically induced mechanical forces became smaller than one-tenth of the forces produced in the conventional transformer structure. When the height $H_3$ was selected at a value in the range of about 57% to 63%, the mechanical force was decreased to about a half as small as that of the hitherto known transformer.

Figure 6:
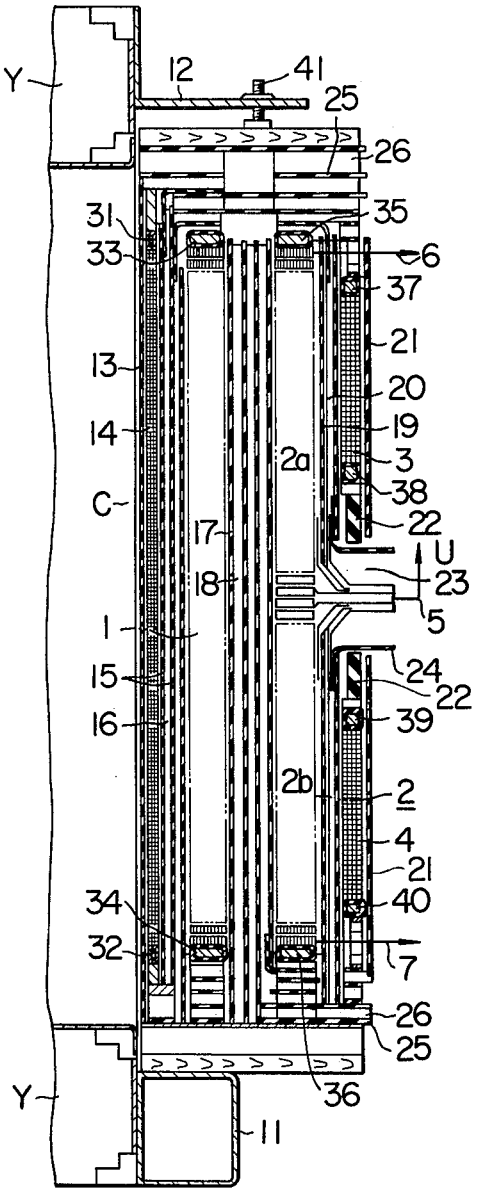
FIG. 6 is a vertical sectional view showing a structure of a high capacity transformer according to the invention for one phase.

FIG. 6 shows in detail a structure of only one phase of a large capacity autotransformer according to the invention. In this embodiment, the low voltage winding 1 as well as the winding units or sections **2*a* and 2*b* constituting the high voltage winding 2 are composed of disc coils, while the individual tap windings 3 and 4 are composed of cylindrical helical coils. Additionally a tertiary winding 14** is provided as a countermeasure of high harmonics and is formed from a helical coil.

The core is composed of each core leg C and upper and lower yokes Y which are respectively provided with clamping members 11 and 12 at the side surfaces thereof for clamping and securing together the core and the windings. The core leg C is provided with an insulation cylinder 13 and is wound sequentially with the tertiary winding 14, the low voltage winding 1 and the high voltage winding 2 and the upper and lower tap windings 3 and 4 in this order. The upper and lower tap windings 3 and 4 are distanced from each other at predetermined locations by means of a cylindrical insulation support 22 which is applied with phenol resin, for example, and formed with an opening 23 for leading out the lead wire 5. In order to maintain a predetermined insulation distance between the individual windings, a plurality of insulation cylinders 15, 17 and 19 and straight duct pieces 16, 18 and 20 are alternately disposed to constitute a main insulation in cooperation with oil in a known manner. An insulation cylinder 21 surrounds exteriorly the individual tap windings 3 and 4. Shield rings 31, 32, . . . . , 39 and 40 each coated with an insulation layer are disposed at the top and bottom ends of the windings with end insulations made of disk-like insulation 25, duct piece 26 or the like being interposed between the windings and the clamping member 11 or 12 in a well known manner. A clamping securing means 41 mounted on the upper clamping member 12 serves to hold together fixedly the windings with a predetermined pressing force.

Connection leading wires (not shown) applied with suitable insulation are led out from the top and bottom ends of each of the low voltage winding 1 and the tertiary winding 14 through the associated end insulations. The lead wire 5 suitably insulated is led out from the axial center portion of the high voltage winding 2 at which the opposite ends of the winding sections **2*a* and 2*b* constituting the winding 2** are connected to each other and extend to the terminal U for connection to a high voltage transmission line. The connection lead-out wires 6 and 7 applied with an insulation coating are led out from the top and bottom end portions of the high voltage winding 2. The lead wire 5 which extends through the bores of the insulation sleeve 19 and the supporting cylinder 22 is provided with a cylindrical insulation 24 formed with a flange and imparted with a high dielectric strength since a high voltage has to be dealt with. A supporting cylindrical or annular insulator 22 is interposed between the opposite ends of the tap windings 3 and 4 each of which is constructed in a manner described hereinafter to provide a plurality of tap leads (not shown) connected to the associated tap changer.

Since this embodiment relates to an autotransformer, the low voltage winding 1, the high voltage winding 2 and the upper and lower tap windings are used as wired in such a manner as shown in FIG. 2.

It will be understood that the tap windings 3 and 4 are so disposed that the magnetic center of each of the tap windings 3 and 4 are located at the height which corresponds to a value in the range of 55 to 65% of half of the overall height of the high voltage winding 2, i.e. the height as measured from the center portion of the winding 2 where the conductor 5 is led out to the end of the winding 2 in a similar manner as is shown in FIG. 5A. Additionally, the top and bottom ends of the respective upper and lower tap windings 3 and 4 are located as retracted inwardly relative to the outer ends of the high voltage winding 2. With such an arrangement, it is possible to reduce significantly the axially induced electromagnetic force produced in the tap windings 3 and 4. In other words, this arrangement also allows the simplified supporting of the windings without fear of the supporting structure being destructed due to the electro-magnetic forces of the tap windings and thus contributes to an enhanced reliability of the transformer. Further, the arrangement according to the invention permits the connection wires 6 and 7 to be led out horizontally from the top and bottom ends of the high voltage winding 2 through the available spaces at the top or the bottom end of the tap windings 3 and 4 without giving rise to any difficulties in insulation.

Figure 7:
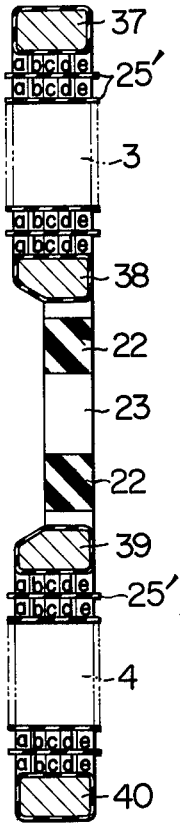
FIGS. 7 and 8 are vertical sectional views showing different embodiments of the tap winding usable in high capacity transformers according to the invention.
Figure 8:
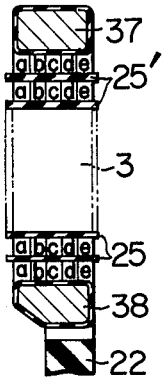

Each of the tap windings 3 and 4 maintained with a predetermined distance therebetween by means of the annular insulation 22 having the lead-out opening 23 may be implemented in a cylindrical helical or other configuration as shown in FIGS. 7 and 8. In the structure shown in these figures, a plurality of insulated conductors *a, b, c . . ., e* of a rectangular cross-section are juxtaposed to one another and wound helically or spirally with the plate like duct piece 25′ being interposed. The terminated end of a wound conductor is connected to the beginning end of another conductor to be wound with predetermined tap lead-out wires being taken out. In this connection, it should be appreciated that, so far as the above described requirement as to the location of the magnetic centers of the tap windings 3 and 4 is fulfilled, the tap windings may be constructed in any suitable configurations and arrangements. Irrespective of the winding arrangement of the transformer, in order to adjust the height of the magnetic centers of the tap windings 3 and 4 in such a manner as mentioned above, the supporting annular insulation 22 may be shortened in so far a sufficient insulation for the lead wire 5 is assured, the number of the juxtaposed conductors of the tap windings 3 and 4 may be varied, the conductors for the tap winding may be stacked and wound to thereby form a multi-stacked cylindircal helical structure, or the plate-like conductor piece 25′ disposed closer to the supporting annular insulator 22 may be made thicker than the others as shown in FIG. 8.

In the case of the embodiments shown in FIGS. 7 and 8, each of the shield rings 38 and 39 disposed at the side of the supporting annular insulation 22 for the tap windings 3 and 4 has a reduced flat portion by rounding the corner thereof at the lead-out side of the lead wire 5 with a view to obviating the concentration of the electric field produced by leading out a large current. Correspondingly, the supporting cylindrical insulator 22 is made thinner. With this arrangement, the oil gaps which would be otherwise formed between the supporting cylinder 22 and the shield rings 38 and 39 can be eliminated, thereby to prevent positively any danger of the occurrence of partial discharge and dielectric destruction.

We claim:

1. A transformer of a large capacity for an ultra-high voltage comprising a core leg which is coaxially wound sequentially with at least a low voltage winding, a high voltage winding composed of an upper and a lower winding section, and an upper and a lower tap winding, said high voltage winding having a lead conductor led out from a center portion of said high voltage winding at which the opposite ends of said winding sections are connected to each other and having connection lead-out conductors taken out from top and bottom end portions of said high voltage winding, said lead conductor led out from the center portion of said high voltage winding extending to a terminal to be connected to a high voltage transmission line, said upper and lower tap windings being disposed vertically and being spaced from each other with a predetermined distance, said upper and lower sections of said high voltage winding being respectively connected to said upper and lower tap windings so that said upper and lower sections operate in a parallel relation to each other respectively through said upper and lower tap windings, wherein said upper and lower tap windings are disposed such that the magnetic center of each of said upper and lower tap windings is located at a height which corresponds to a value in a range of 55% to 65% of the height between said center portion and each end portion of said high voltage winding.

2. A transformer as set forth in claim 1, wherein said upper and lower tap windings are spaced from each other with said predetermined distance by means of an insulative supporting cylindrical member disposed between said upper and lower tap windings and formed with an opening to take out therethrough the lead wire from said center portion of said high voltage winding.

3. A transformer of a large capacity for an ultra-high voltage comprising a core leg which is coaxially wound sequentially with at least a low voltage winding, a high voltage winding composed of an upper and a lower winding section, and an upper and a lower tap winding, said high voltage winding having a lead conductor led out from a center portion of said high voltage winding at which the opposite ends of said winding sections are connected to each other and having connection lead-out conductors taken out from top and bottom end portions of said high voltage winding, said lead conductor led out from the center portion of said high voltage winding extending to a terminal to be connected to a high voltage transmission line, said upper and lower tap windings being disposed vertically and being spaced from each other with a predetermined distance, said upper and lower sections of said high voltage winding being respectively connected to said upper and lower tap windings so that said upper and lower sections operate in a parallel relation to each other respectively through said upper and lower tap windings, wherein said upper and lower tap windings are disposed such that the magnetic center of each of said upper and lower tap windings is located at a height which corresponds to a value in a range of 55% to 65% of the height between said center portion and each end portion of said high voltage winding, and wherein the top end of said upper tap winding and the bottom end of said lower tap winding are inwardly retracted relative to the top and bottom end portions of said high voltage winding, respectively.

4. A transformer as set forth in claim 3, wherein said upper and lower tap windings are spaced from each other with said predetermined distance by means of an insulative supporting cylindrical member disposed between said upper and lower tap windings and formed with an opening to take out therethrough said lead wire from said center portion of said high voltage winding.

5. A transformer as set forth in claim 3, wherein said connection lead-out wires from said top and bottom ends of said high voltage winding are led out horizontally, through insulation spaces available at the top portion of said upper tap winding and the bottom portion of said lower tap windings, respectively.

6. A transformer of a large capacity for an ultra-high voltage comprising a core leg which is coaxially wound sequentially with a tertiary winding, a low voltage winding, a high voltage winding composed of an upper and a lower winding section, and an upper and a lower tap winding, said high voltage winding having a lead conductor led out from a center portion of said high voltage winding at which the opposite ends of said winding sections are connected to each other and having connection lead-out conductors taken out from top and bottom end portions of said high voltage winding, said lead conductor led out from the center portion of said high voltage winding extending to a terminal to be connected to a high voltage transmission line, said upper and lower tap windings being disposed vertically and being spaced from each other with a predetermined distance, said upper and lower sections of said high voltage winding being respectively connected to said upper and lower tap windings so that said upper and lower sections operate in a parallel relation to each other respectively through said upper and lower tap windings, wherein said upper and lower tap windings are disposed such that the magnetic center of each of said upper and lower tap windings is located at a height which corresponds to a value in a range of 55% to 65% of the height between said center portion and each end portion of said high voltage winding, said upper and lower tap windings being spaced from each other with said predetermined distance by means of an insulative supporting cylindrical member disposed between said upper and lower tap windings and formed with an opening for taking out therethrough said lead-out conductor from said center portion of said high voltage winding, and wherein the top end portion of said upper tap winding and the bottom end portion of said lower tap winding are inwardly retracted relative to said top and bottom end portions of said high voltage winding, respectively, whereby said connection lead-out conductors led out from said top and bottom end portions of said high voltage winding are taken out horizontally through insulation spaces available at the top end portion of said upper tap winding and the bottom end portion of said lower tap winding, respectively.

* * * * *